United States Patent [19]

McIntire

[11] Patent Number: 4,490,932

[45] Date of Patent: Jan. 1, 1985

[54] ADVERTISING SIGN SUPPORT

[76] Inventor: Andrew N. McIntire, 1303 SE. 22nd Ave., Mineral Wells, Tex. 76067

[21] Appl. No.: 407,083

[22] Filed: Aug. 11, 1982

[51] Int. Cl.[3] ..... G09F 11/02

[52] U.S. Cl. ..... 40/473; 40/124; 40/617

[58] Field of Search ..... 40/124, 473, 493, 617, 40/472

[56] References Cited

U.S. PATENT DOCUMENTS

| | | | |
|---|---|---|---|
| 336,478 | 2/1886 | Fawkes | 40/473 |
| 2,621,429 | 12/1952 | Teich | 40/493 |
| 2,998,664 | 9/1961 | McIntire | 40/473 |
| 3,175,318 | 3/1965 | Bayer | 40/524 |

FOREIGN PATENT DOCUMENTS

| | | | |
|---|---|---|---|
| 1472163 | 1/1967 | France | 40/493 |

*Primary Examiner*—Gene Mancene
*Assistant Examiner*—Wenceslao J. Contreras
*Attorney, Agent, or Firm*—Clarence A. O'Brien; Harvey B. Jacobson

[57] ABSTRACT

An exhibiting device in the form of a cabinet having a base, side walls and a top wall extending across the side walls thereof above the base, the side walls thus forming compartments between the top wall and the base with open fronts for the compartment. Rotors are centrally and vertically disposed in the compartments and have at one end a conic termination for the rotor in the base and engage supporting means in the base receiving the conic termination, the rotors having at the other end a drive termination and a supporting member engaging the top wall. A panel configured as a regular polygon and constructed of rigid material is supported proximate the drive means on the rotor. A hanger is disposed centrally along each side of the polygon for hanging displaying panel members or advertising elements and located in such relationship that the displaying panel members occupy different planes spaced longitudinally of the rotor. A hinged convex curved member overlies the top wall.

1 Claim, 5 Drawing Figures

ADVERTISING SIGN SUPPORT

BACKGROUND OF THE INVENTION

Field of the Invention

The present invention relates to exhibiting devices for continuous advertising, and more particularly to a useful improvement in changeable exhibiting signs having a novel cabinet characterized by a centrally disposed compartment containing a clock and provided with several additional and side compartments provided with rotating vertical shafts providing for rotation of advertising signs.

In the invention the changeable exhibiting signs rotate about a shaft having a conic bottom for rotating in ball bearings and having an upper end driven by a motor and in which supported from the shaft in generally perpendicular relation is a panel of a regular polygonal configuration such as a regular pentagon. On each of the sides of the pentagon, about the middle there is a hook provided for support of removable and changeable exhibiting signs.

DESCRIPTION OF PRIOR ART

Various U.S. patents relate to exhibiting devices for continuous advertising and of interest to the present invention are the following U.S. Pat. Nos.:

1,589,292—G. Chortanian et al.
1,619,096—H. H. Walsh
1,631,870—S. Katz
2,863,237—M. Matthews
2,998,664—A. N. McIntire
3,078,606—A. N. McIntire The patent to Matthews discloses a housing containing a rotor having an octagonal top and frame supported through a square cut hole and from which are supported for rotation certain informational data cards. A motor has a gear reduction box to drive the shaft for turning the rotor. The prior patents to McIntire and the other patents disclose features of more general interest. None of these patents discloses all of the specific details of the present invention in such a way as to bear upon the patentability of any claims of the present invention.

SUMMARY OF THE INVENTION

An object and advantage of the present invention is to provide a new and improved advertising sign support structure for continuous advertising display of each of several signs.

An additional object of the present invention is to provide a new and improved exhibiting device for continuous advertising structured for long life, and in which all of the signs swing in supported relation from a center of a panel in the shape of a regular polygon rotated with a supporting shaft. The shaft is driven from the top and has a threaded portion extending downwardly for providing support of a panel centrally mounted on the shaft and securably held in place by a set of washer-and-nut elements to hold the panel in tight securement. A sleeve is disposed around the shaft for the shaft to rotate with respect to a top wall while the bottom end of the shaft is conically constructed and arranged to engage with a set of ball bearings disposed in an oil-and-grease cup supporting the shaft from a bottom wall or surface so that the shaft imposes little strain on the motor by reason of friction imposed on the shaft. The motor is at the top of the shaft and supported by the top wall, for example, and turns the shaft which in turn rotates the panel supporting the display signs. The panel provides for display of five distinct signs and is useful in many commercial establishments that desire to provide display information concerning daily sales that are available such as during a five day business week and the like. Centrally and above the top wall and extending parallel with the front face of the structure is a hinged arcuate front face member for mounting from a front portion or surface thereof a clock and in which the arcuate member is supportably mounted by a piano hinge from the top wall, so that the arcuate member is collapsible when the arrangement is stored or in a shipping status.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF A PREFERRED EMBODIMENT

Figure 1:
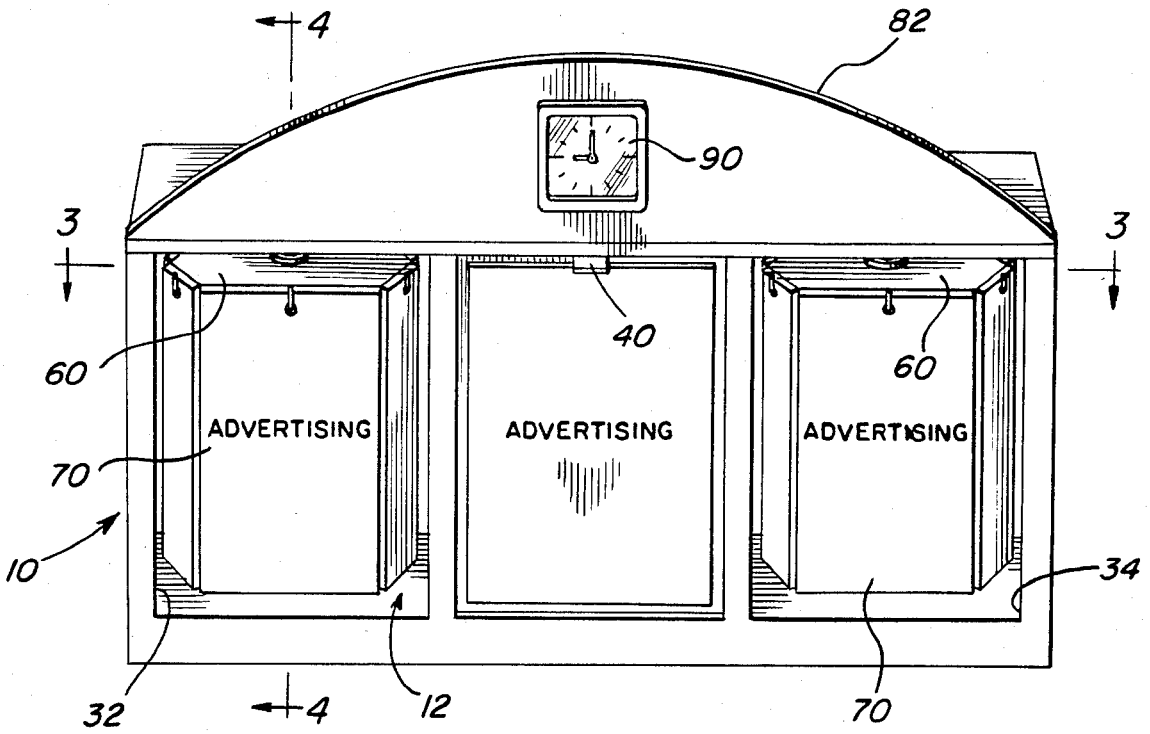
FIG. 1 is a front perspective view of the continuous advertising sign support assembly according to the present invention.
Figure 2:
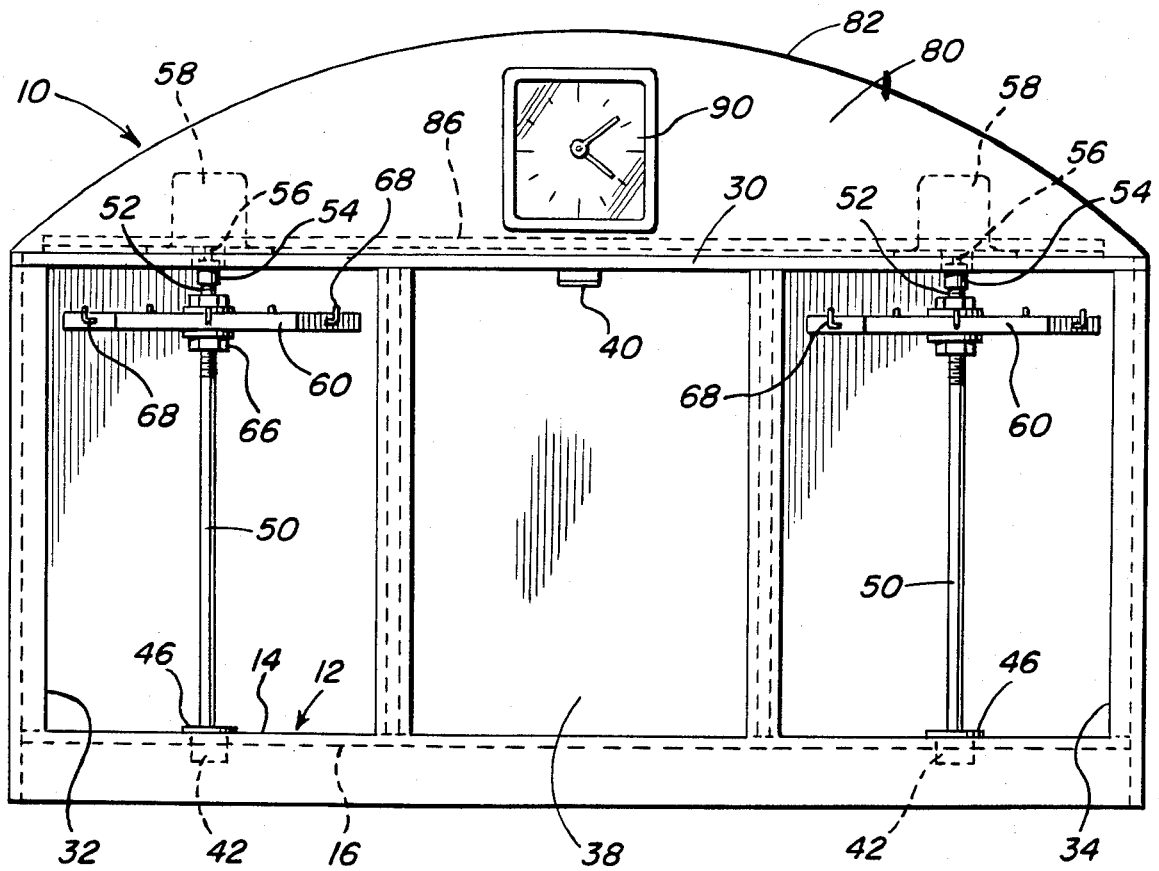
FIG. 2 is a front elevational view with the advertising material removed.

Referring now to the drawings there is shown a continuous advertising sign support assembly 10 including a base member 12 consisting of a wall board or panel that is generally flat throughout its upper and lower surfaces 14, 16, side walls 18, 20, 22, 24, 26, 28, and a top wall 30. Side walls 18–28 and top wall 30 also consist of wall board or panels which are generally flat through their respective surfaces, even through the side wall 28 comprises a front surface wall and has windows or apertures 32, 34 sufficiently large for receiving advertising signs or matter to be described below. Adjacent pairs of side walls 20, 22 and 22, 24 and 24, 26 define or form compartments between the top and the base formed together with the side wall 18 positioned in the rear and with the side wall 28 positioned in front and having the apertures 32, 34. The compartment formed by side walls 22, 24 is covered by a front closure or front wall 36 spanning the side walls 22, 24 and recessed inwardly of the side wall 28 forming the front surface wall. Disposed upon the front surface of wall 36 there is supportably hung a stationary advertisement sheet 38 and the like that is affixed or hung or supported by the wall 36 by conventional fastener means 40.

In the respective compartments formed by side walls 20, 22 and 24, 26 there is a generally centrally disposed lower support member 42 mounted in an aperture formed in the base member 12 and consisting essentially of an oil or grease cup with a recessed portion for containing a series of ball bearings 44, such as three ball bearings, and having an outwardly extending upper support lip 46.

Received in rotational engagement within the lower support member 42 is a conic termination 48 of a shaft or rotor 50 having a long, cylindrical configuration throughout its intermediate portion. The shaft 50 may be of plastic, metal or other material and including materials such as aluminum, stell or iron. An upper end of the shaft 50 contains a threaded coupling or termination 52 threadedly connecting into a drive member 54 on a motor shaft 56 forming a part of the drive member or motor 58.

Along an upper intermediate portion of the rotor shaft 50 there is supportably mounted along the threaded termination 52 a support panel 60 configured as a regular polygon such as a pentagon and having a central aperture 62 receiving the shaft 50 and securely held in place by upper and lower sets of washers and nuts 64, 66. In this manner the panels 60 are securely disposed in a perpendicular relation about the shaft 50 while the shaft 50 is rigidly held upright by the ball bearings 44 in the support member 42 at one end and by the drive member 54 engaging the threaded termination 52 at the other end of the shaft 50.

Figure 3:
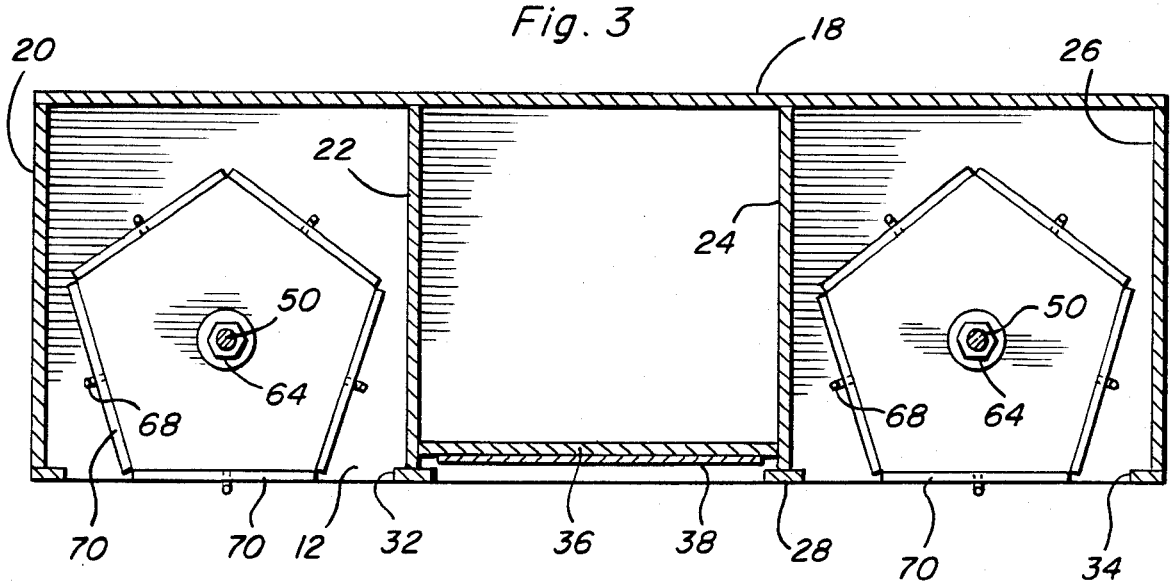
FIG. 3 is a sectional view taken along lines 3—3 of FIG. 1.
Figure 4:
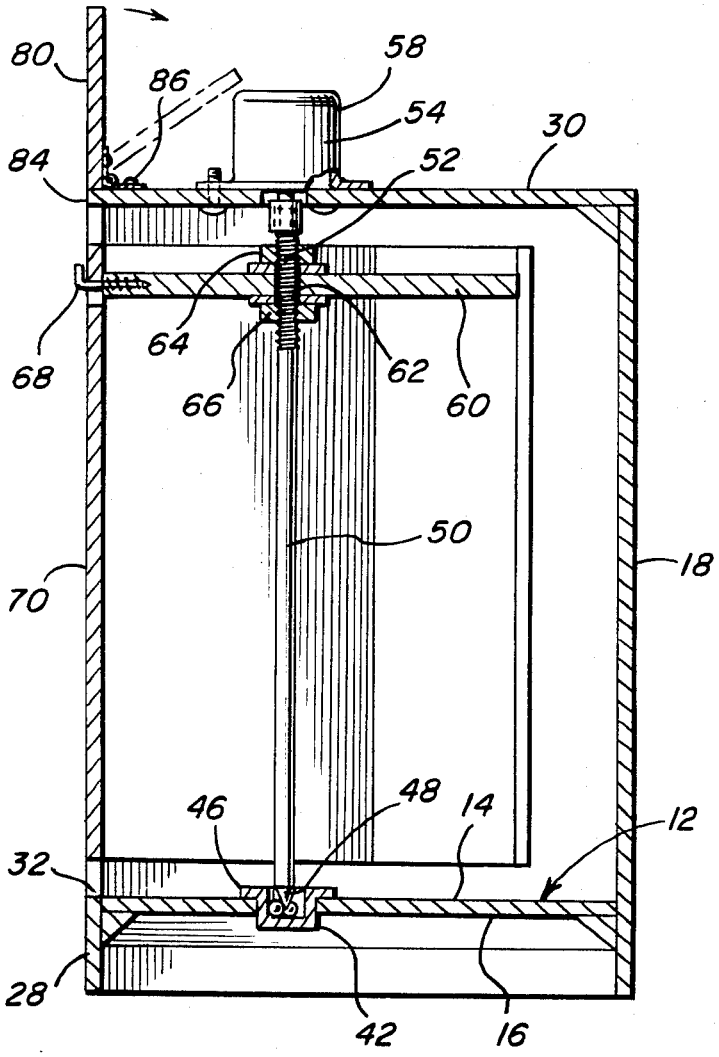
FIG. 4 is a sectional view taken along lines 4—4 of FIG. 1.
Figure 5:
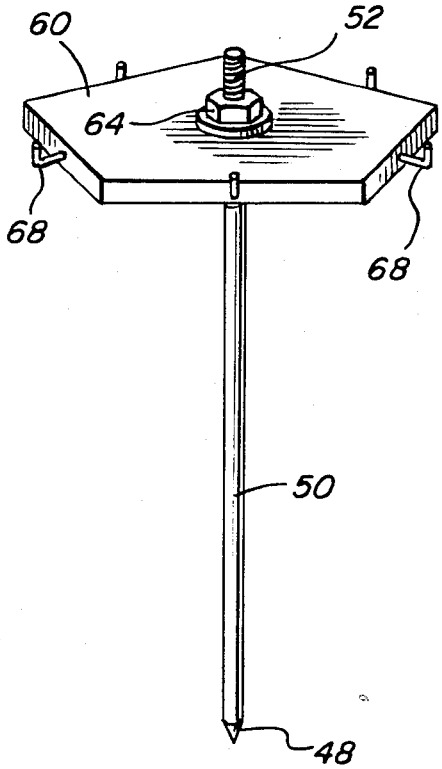
FIG. 5 is a perspective view of the rotor and the regular polygon panel for supporting advertising material according to the invention.

On each side of the regular polygon of the panel 60 there is at least one support or hook member 68 for supporting generally rectangular display boards 70 for providing revolving advertising spaces equal to the number of sides of the polygon for each compartment within sides 20, 22 and 24, 26. The display boards occupy different planes of a regular polygon spaced in the compartment and each longitudinally of the shaft 50. The use of the shape of a regular pentagon provides a series of five equal advertising spaces that revolve about the shaft 50 and provide for separately relevant selections of five advertisements forming a series that can be included in sequence about the hook members 68 of any given board 70. The boards can be changed, removed, alternated in sequence and with the boards of the other compartments, whether the compartment formed by side walls 20, 22 or 24, 26 to provide maximum versatility in uses of the sides of the panels supporting boards 70. As clearly shown in FIGS. 3 and 4, the location of shafts 50 and the size of panels 60 are such that with each rotor, one of the boards 70 is disposed in substantially the same vertical plane as the apertures 32, 34.

The front wall formed by side wall 28 has an extension surface member 80 forming an arcuate or convex curved edge and surface 82 along an upper portion while a straight edge portion 84 is provided to engage with the top wall 30 and an upper edge of the front side wall 28. The straight edge portion is secured to the walls 28, 30 by a fastener or piano hinge member 86. Centrally of the extension member 80 is securably located and fixed in mounted relation a clock 90 and the extension member 80 with the clock is adapted so the member 80 folds downwardly upon the top wall 30 providing a compactness of the assembly 10 when it is being stored or shipped. The motors 58 are capable of being removed from the top wall 30 should adequate space or added space be required for shipping. The oval portion of the extension 80 may fold downwardly partially or completely depending on a given size and configuration of a housing of the motor 58.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A display device comprising a cabinet having a substantially planar front viewing area, polygonally-shaped support means rotatably mounted in said cabinet for selective positioning of respective sides of the support means in substantially coplanar registry with said viewing area, drive means connected to said support means, and means on the respective sides of said support means to removably support a plurality of display items for movement into registry with said viewing area, wherein said viewing area is a vertically disposed window, said support means including a vertically disposed shaft journaled in the cabinet, a support member mounted on the upper end portion of the shaft, said support member including a polygonal peripheral edge with a portion of the edge being disposed adjacent the viewing area, said means supporting display items including a plurality of hooks mounted in circumferentially spaced relation on said edge of the support member, a rectangular planar display panel supported from each of said hooks, the display panels conforming in width to the respective portions of the polygonal edge and being disposed in substantially contiguous relation defining an enclosed polygonal cylinder, said drive means including a motor having an output drivingly connected to the upper end of the shaft.

* * * * *